US011536523B2

(12) United States Patent
Ayotte et al.

(10) Patent No.: US 11,536,523 B2
(45) Date of Patent: Dec. 27, 2022

(54) SLIDING FEED TRAY COVER FOR BELT-FED WEAPON

(71) Applicant: Textron Systems Corporation, Hunt Valley, MD (US)

(72) Inventors: Kevin Michael Ayotte, Acworth, GA (US); Andrew Joseph Bosley, Catonsville, MD (US); Ed Charles Volz, Rosedale, MD (US); Leonard Terrence Katilas, Essex, MD (US)

(73) Assignee: Textron Systems Corporation, Hunt Valley, MD (US)

( * ) Notice: Subject to any disclaimer, the term of this patent is extended or adjusted under 35 U.S.C. 154(b) by 0 days.

(21) Appl. No.: 17/331,781

(22) Filed: May 27, 2021

(65) Prior Publication Data

US 2021/0372718 A1 Dec. 2, 2021

Related U.S. Application Data

(60) Provisional application No. 63/159,617, filed on Mar. 11, 2021, provisional application No. 63/032,671, filed on May 31, 2020.

(51) Int. Cl.
*F41A 3/66* (2006.01)
*F41A 9/29* (2006.01)

(52) U.S. Cl.
CPC . *F41A 3/66* (2013.01); *F41A 9/29* (2013.01)

(58) Field of Classification Search
CPC ..... F41A 3/66; F41A 9/29; F41A 9/30; F41A 9/31; F41A 9/32; F41A 9/33; F41A 9/34
USPC ..... 89/33.2, 33.25, 34
See application file for complete search history.

(56) References Cited

U.S. PATENT DOCUMENTS

| | | | | |
|---|---|---|---|---|
| 3,955,469 | A * | 5/1976 | Conley | F41A 9/33 89/33.14 |
| 4,066,000 | A * | 1/1978 | Rostocil | F41A 21/36 89/34 |
| 6,634,274 | B1 | 10/2003 | Herring | |
| 8,136,440 | B1 | 3/2012 | Shirts et al. | |
| 8,820,212 | B2 | 9/2014 | Rostocil | |
| 9,488,425 | B2 | 11/2016 | Delury et al. | |
| 9,879,931 | B2 | 1/2018 | Patel | |
| 10,180,296 | B2 | 1/2019 | Polston | |
| 11,156,415 | B2 * | 10/2021 | Franssen | F42B 39/08 |
| 2018/0058816 | A1 * | 3/2018 | Geissele | F41A 3/66 |

* cited by examiner

*Primary Examiner* — Bret Hayes
(74) *Attorney, Agent, or Firm* — BainwoodHuang

(57) ABSTRACT

A feed tray assembly for a belt-fed weapon includes a bottom tray portion configured for mounting at a top of the weapon. The feed tray assembly further includes a feed tray cover mounted to the bottom tray portion and configured for lateral sliding opening and closing movement, such as on laterally extending pins riding in corresponding channels of the bottom tray portion. The feed tray cover has (1) a closed position in which it covers the bottom tray portion to retain the belt of ammunition during operation, and (2) an open position laterally displaced from the closed position to enable insertion of the belt of ammunition. Due to this lateral sliding movement of the feed tray cover, a sighting optic may be mounted on the weapon with a forward portion directly above the feed tray assembly without any undesired mechanical interference.

16 Claims, 6 Drawing Sheets

SLIDING FEED TRAY COVER FOR BELT-FED WEAPON

STATEMENT OF GOVERNMENT RIGHTS

The invention was made with Government support under US Army contract W15QKN-19-9-1025. The Government has certain rights in the invention.

BACKGROUND

The invention is generally in the field of small arms, and relates specifically to improved feeding mechanisms for belt-fed weapons.

Some belt-fed weapons are transitioning to using more advanced optics that take up more rail space on the top rail of the weapons. Due to the size and required eye relief, there is a potential for interference between these optics and the operation of loading and clearing rounds from a belt feed tray also located at or near the top of the weapon.

It has been known to use hinged belt feed covers with belt-fed weapons. In some cases the weapons have been used without larger optics and thus did not experience such interference between the feed tray cover and the optics. In another known arrangement with a hinged feed tray cover, the whole rear rail hinges up with the cover. This approach has several issues including that the cover is required to be as long as from the rear of the weapon to the feeding position; not providing a reliable zero for the optic which rides with a moving piece that locks, unlocks, and hinges; and reducing the reliability of the system by attached heavy optics to hinging components.

SUMMARY

A disclosed arrangement addresses the problem of potential interference between the feed tray cover and a rail-mounted optic by employing a feed tray cover that slides and translates between closed position and open position horizontally, such as to the shooter's right for example. This is opposed to conventional covers which hinge open upwardly and would thus interfere with an optic installed on the top rail. The disclosed slide mechanism allows the user to simply open the feed tray cover and load new rounds without having to adjust the position of the optic or lose sight picture. This system also allows the optic to be mounted directly to the weapon receiver, thus providing a more robust mounting method and improved zero retention.

More particularly, a feed tray assembly for a belt-fed weapon is disclosed that includes a bottom tray portion configured for mounting at a top of the belt-fed weapon, the bottom tray portion accepting a belt of ammunition for loading and firing a succession of rounds. The feed tray assembly further includes a feed tray cover mounted to the bottom tray portion and configured for lateral sliding opening and closing movement, such as on laterally extending pins riding in corresponding channels of the bottom tray portion. The feed tray cover has (1) a closed position in which it covers the bottom tray portion to retain the belt of ammunition during operation, and (2) an open position laterally displaced from the closed position to enable insertion of the belt of ammunition. Due to this lateral sliding movement of the feed tray cover, a sighting optic may be mounted on the weapon so as to have a forward portion directly above the feed tray assembly without any undesired mechanical interference.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views.

DETAILED DESCRIPTION

Figure 1:
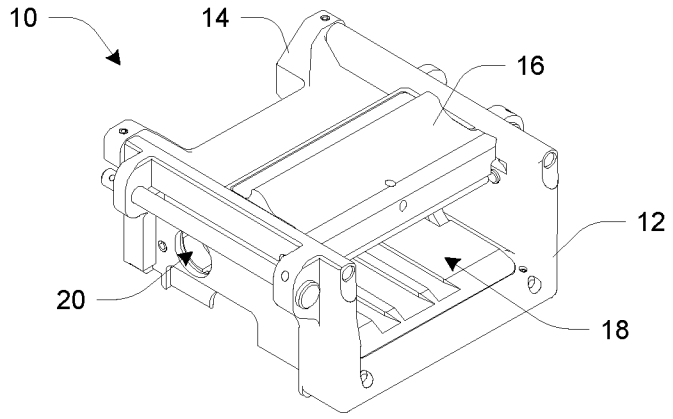
FIG. 1 is a perspective view of a feed tray assembly with feed tray cover in closed position.

FIG. 1 shows a feed tray assembly 10 having a cup-shaped bottom portion 12 (also referred to as "bottom tray portion") and an upper feed tray cover 14, which includes a release button 16 for opening the feed tray cover 14. The feed tray assembly 10 (also referred to as "feed tray") has a lateral opening 18 for receiving a belt of ammunition. In operation, successive rounds or cartridges are fed into alignment with an axial opening 20 that aligns with a firing chamber of a weapon in which the feed tray assembly 10 is mounted, enabling the rounds to be rammed into the firing chamber and then fired, as generally known in the art. The present description focuses on the feed tray cover 14 in particular; the detailed structure and operation the belt feed mechanism are generally not relevant and thus not elaborated herein.

FIG. 1 shows the feed tray cover 14 in the closed position, as it is during operation when an ammunition belt is present. As described in more detail below, the release button 16 is depressed downward by an operator in order to open the feed tray cover 14, for example to load an ammunition belt or clear the feed tray of debris etc. When the release button 16 is pushed downward, the feed tray cover 14 is unlocked and can be slid laterally into an open position, which is shown and described with reference to FIG. 2. The feed tray cover 14 may be moved completely manually in both directions between open and closed. Alternatively, it may be spring loaded in one direction (either open or closed), and a manual operation used to move it against the spring force in the opposite direction.

Figure 2:
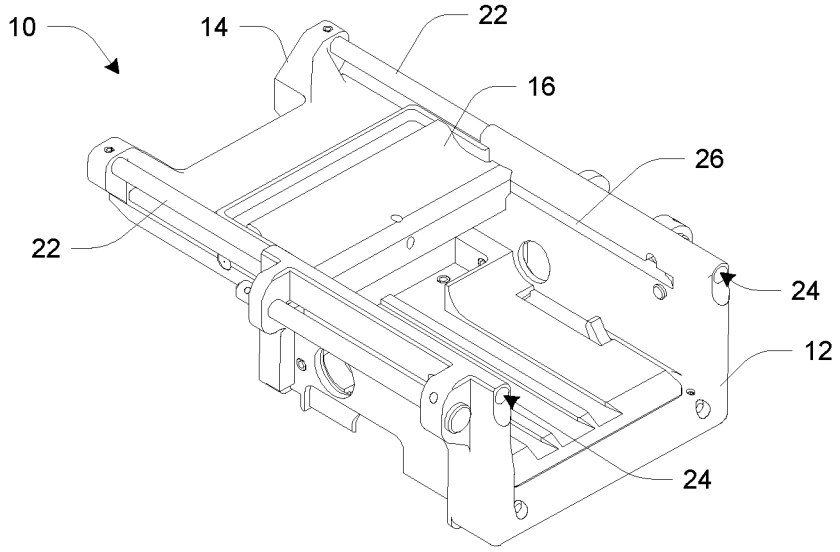
FIG. 2 is a perspective view of the feed tray assembly with feed tray cover in open position.

FIG. 2 shows the feed tray cover 14 in the open position. The feed tray cover 14 includes elongated pins 22 that ride in corresponding elongated channels 24 of the bottom portion 12, providing for the lateral sliding motion of the feed tray cover 14 relative to the bottom portion 12. Also visible in FIG. 2 is a slot referred to as a "cam path" 26, which provides for locking the feed tray cover 14 in the closed position as well as limiting travel of the feed tray cover 14 when opened, as described in more detail below.

Figure 3:
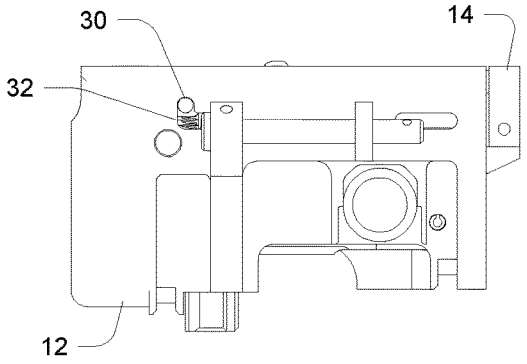
FIG. 3 is a side view of the feed tray assembly with feed tray cover in closed position.
Figure 4:
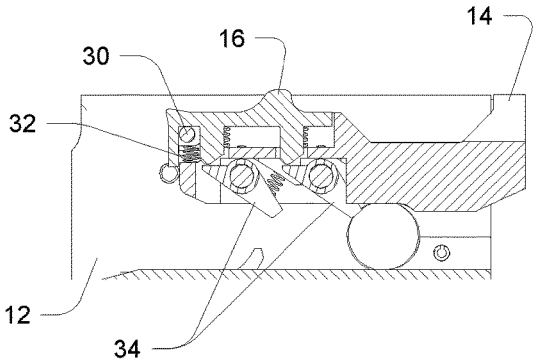
FIG. 4 is a side sectional view of the feed tray assembly with feed tray cover in closed position.

FIGS. 3 and 4 are side and side-section views respectively of the feed tray assembly 10 with feed tray cover 14 in closed position. Visible in these views are a cross pin 30 (seen on end) which is biased upward by a spring 32, both carried by the feed tray cover 14. Each end of the cross pin 30 extends into a respective cam path 26 (FIG. 2) of a respective side wall of the bottom portion 12. With the feed tray 14 in the closed position as shown, the cross pin 30 sits in an upward-facing end of the cam path 26, preventing the feed tray cover 14 from moving laterally (i.e., locking it closed). As shown in FIG. 4, the cross pin 30 and spring 32 are covered by an end portion of the release button 16, so that depressing the release button 16 pushes the cross pin 30 downward against the spring force, into an unlocked position. Also shown in FIG. 4 are pawls 34 that serve to hold belted rounds in place. The pawls 34 have limited-range, spring-loaded rotation to provide a ratchet-type advancing action for belted cartridges.

Figure 5:
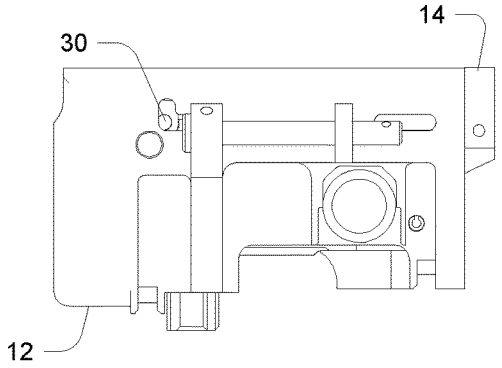
FIG. 5 is a side view of the feed tray assembly with a cover release button depressed.
Figure 6:
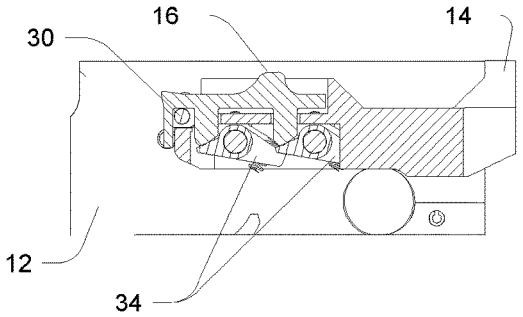
FIG. 6 is a side sectional view of the feed tray assembly with the cover release button depressed.

FIGS. 5 and 6 illustrate the feed tray cover 14 in unlocked position, in which the release button 16 is depressed and the cross pin 30 has been pushed down, enabling lateral travel of the feed tray cover 14 into the open position. As shown in FIG. 6, depressing the button 16 rotates the pawls 34 into recessed positions so that they are clear from contacting any rounds that may be present, also enabling lateral travel of the feed tray cover 14 into the open position.

Figure 7:
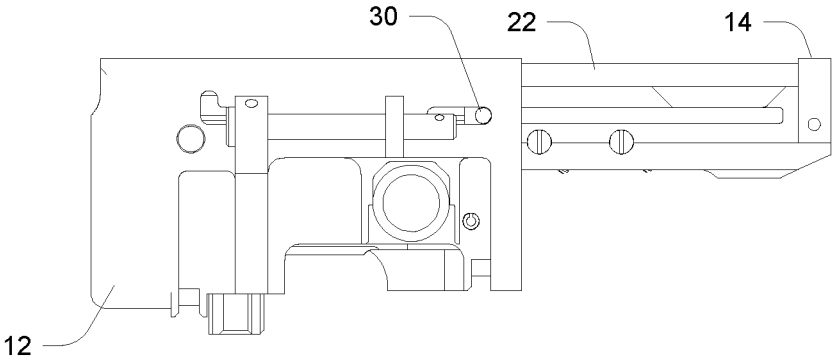
FIG. 7 is a side view of the feed tray assembly with feed tray cover in open position.
Figure 8:
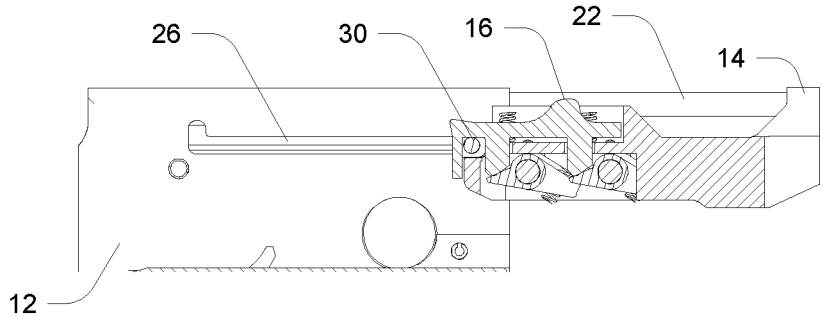
FIG. 8 is a side sectional view of the feed tray assembly with feed tray cover in open position.

FIGS. 7 and 8 are side and side-section views showing the feed tray cover 14 in open position. Visible in FIG. 8 is the cam path 26 on the far wall of the bottom portion 12, in which a corresponding end of the cross pin 30 is riding. Note that when the cross pin 30 is riding in the cam path 26, its connection to the release button 16 maintains the release button 16 in the downward position, which further maintains the pawls 34 in their recessed positions, without requiring that the operation maintain downward (opening) pressure on the release button 16.

In the open position of FIGS. 7 and 8, the feed tray cover 14 extends outward to the shooter's right and clears the space in the feed tray bottom 12 to extract cartridges or load a new belt. When the feed tray cover 14 is slid back left to the closed position, the cross pin 30 reaches the end of the cam path 26 and is pushed upward by spring force, locking the feed tray cover 14 into the closed position (and releasing the pawls 34) as shown in FIGS. 3 and 4.

Figure 9:
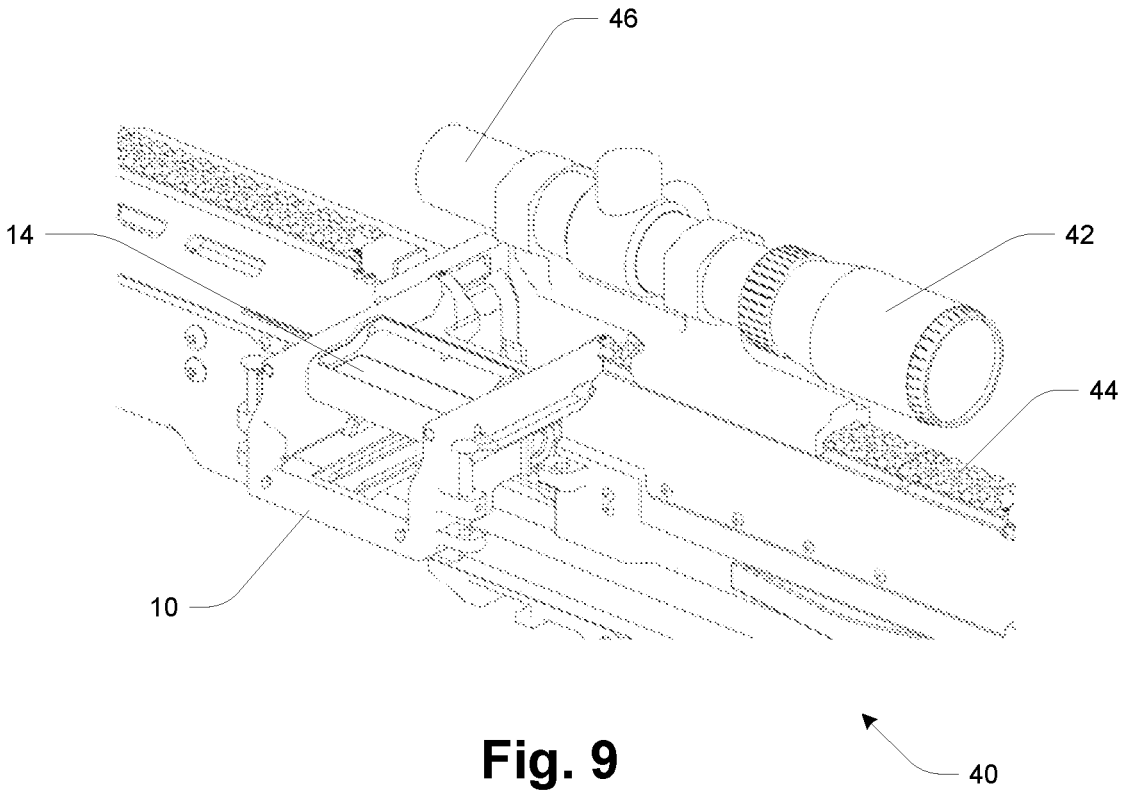
FIG. 9 is a left-side view of a belt-fed weapon with feed tray assembly during installation, having the feed tray cover in closed position.
Figure 10:
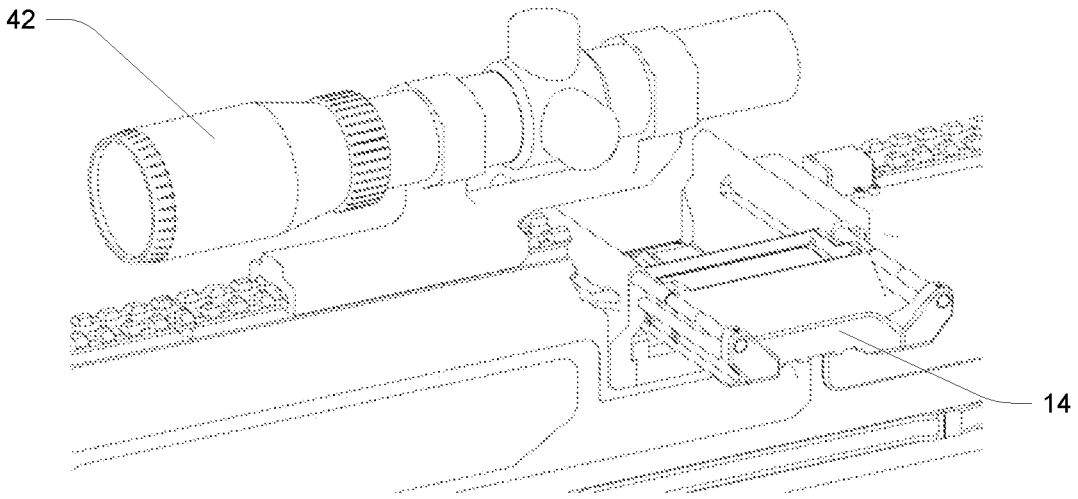
FIG. 10 is a right-side view of a belt-fed weapon with feed tray assembly having the feed tray cover in open position.

FIGS. 9 and 10 show the feed tray assembly 10 during installation and in-place in a belt-fed weapon 40. The left-side view of FIG. 9 shows the fee tray assembly 10 during installation, being slid toward the shooter's right, with the feed tray cover 14 in the closed position. The right-side view of FIG. 10 shows the feed tray assembly fully installed, with the feed tray cover 14 in the open position. As shown the weapon 40 may include a sighting optic or "scope" 42 mounted to an upper rail 44 and having a forward portion 46 that sits directly above the feed tray assembly 10. The lateral opening/closing motion of the feed tray cover 14 means that the feed tray 10 can be opened and closed without any mechanical interference with the forward portion 46 of the sighting optic 42.

Figure 11:
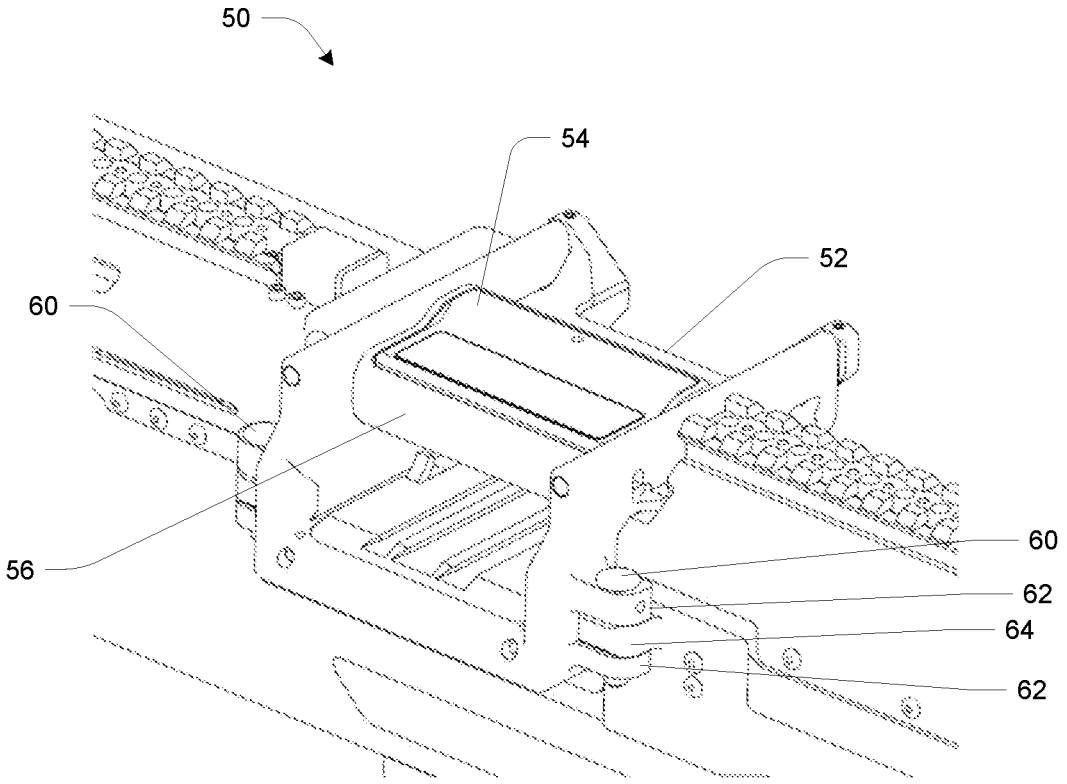
FIG. 11 is a perspective view of an upper portion of a belt-fed weapon having an alternative feed tray assembly employing a shrouded release button and vertical take down pins.
Figure 12:
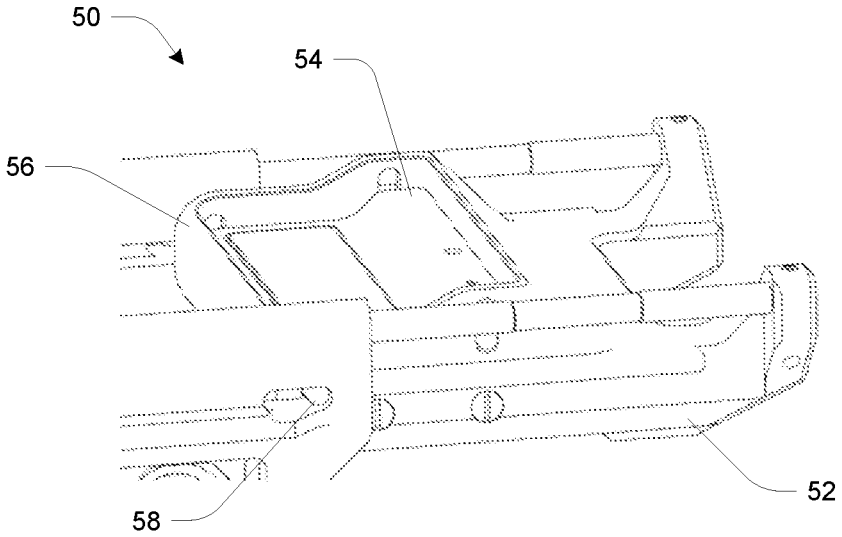
FIG. 12 is a perspective view of a portion of the feed tray assembly of FIG. 11 with feed tray cover in open position.
Figure 13:
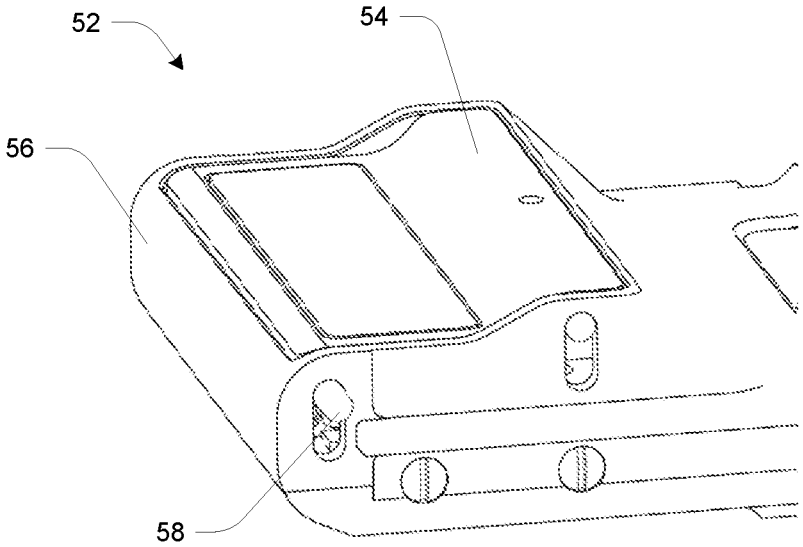
FIGS. 13 and 14 are perspective views of the feed tray cover of FIG. 11 showing release button in non-release (upward) and release (downward) positions respectively.
Figure 14:
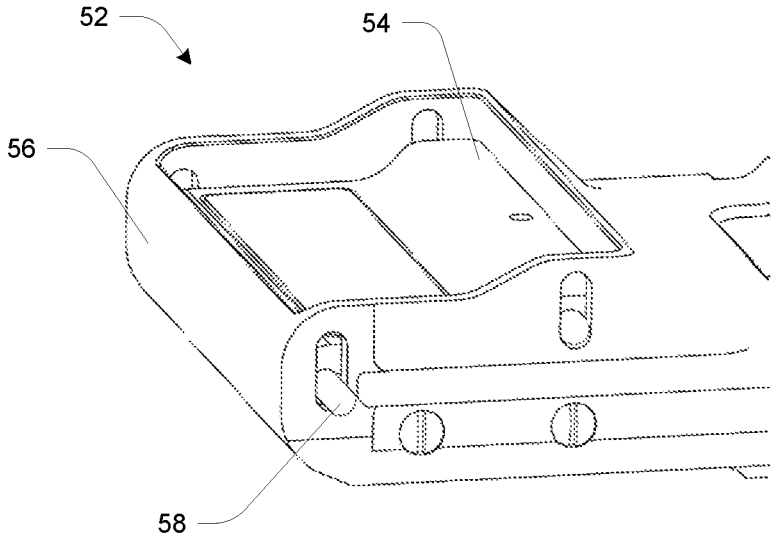

FIG. 11-14 illustrate an alternative embodiment of a feed tray assembly 50 that uses a shrouded button to protect against inadvertent opening of the feed tray cover, especially during operation of the weapon. It will be appreciated that during operation, the ammunition belt itself can have considerable movement that could cause it to strike a release button (e.g., button 16) and inadvertently open the feed tray cover, interfering with regular operation. Shrouding the release button can help protect against such a scenario. FIG. 11 shows the feed tray assembly 50 as installed in a weapon. FIG. 12 shows the feed tray assembly 50 with feed tray cover 52 in open position. FIGS. 13 and 14 show the feed tray cover 52 with release button 54 in upward (locked) position and downward (unlocked/open) position respectively.

More particularly, the feed tray assembly 50 has a feed tray cover 52 carrying a release button 54, generally similar to the arrangement of FIGS. 1-8. The feed tray cover 52 includes a shroud 56 that surrounds the release button 54. It will be appreciated that this arrangement is less sensitive to forces having a more glancing characteristic than the designed-for vertical forces of an operator's fingers depressing the release button 54. For example, a force delivered at an oblique (or off-axis) angle will be exerted against the shroud 56 rather than the release button 54. This aspect can be appreciated in particular with reference to FIGS. 13 and 14, showing the release button 54 in upward (locked) position and downward (unlocked/open) position respectively. The shroud 56 forms a well-like space in which the release button 54 travels vertically, thus limiting the effective forces to those that act vertically on the release button 54 without also acting on the surrounding shroud 56. Also shown in these figures is a cross pin 58 that functions analogously to the cross pin 30 in the embodiment of FIGS. 1-8.

FIG. 11 also shows an embodiment that employs vertical takedown pins 60 extending through retention knuckles 62, 64 (of feed tray and weapon body respectively) that allow for the operator to install the feed tray laterally (as shown in FIG. 9) without having to remove optics or scopes during normal maintenance and field strip.

While various embodiments of the invention have been particularly shown and described, it will be understood by those skilled in the art that various changes in form and details may be made therein without departing from the scope of the invention as defined by the appended claims.

What is claimed is:

1. A feed tray assembly for a belt-fed weapon, comprising:

a bottom tray portion configured for mounting at a top of the belt-fed weapon, the bottom tray portion accepting a belt of ammunition for loading and firing a succession of rounds; and a feed tray cover mounted to the bottom tray portion and configured for lateral sliding opening and closing movement orthogonal to a firing direction of the belt-fed weapon, the feed tray cover having (1) a closed position in which the feed tray cover covers the bottom tray portion to retain the belt of ammunition during operation, and (2) an open position laterally displaced from the closed position to enable insertion of the belt of ammunition, wherein the feed tray cover has a pair of laterally extending pins that ride within corresponding elongated channels of the bottom tray portion to provide for the sliding opening and closing movement of the feed tray cover.

2. The feed tray assembly of claim 1, wherein the feed tray cover includes a release button enabling an operator to unlock the feed tray cover in the closed position and move the feed tray cover to the open position.

3. The feed tray assembly of claim 2, wherein the feed tray cover includes a cross pin having end portions residing in corresponding cam paths of respective side walls of the bottom tray portion, and wherein the release button travels vertically to push the cross pin from a locked position to an unlocked position, enabling the lateral sliding movement of the feed tray cover.

4. The feed tray assembly of claim 3, wherein the cross pin is spring-loaded and the release button applies force against the spring loading.

5. The feed tray assembly of claim 2, wherein the feed tray cover includes a shroud portion surrounding the release button to protect against inadvertent activation of the release button by off-axis forces.

6. The feed tray assembly of claim 2, wherein the feed tray cover includes one or more pawls that rotate between extended and recessed positions based on closed and open positions of the release button respectively, the pawls in the extended position contacting ammunition rounds and retaining them in position in the feed tray assembly, the pawls in the recessed position being clear of ammunition rounds in the feed tray assembly and permitting the feed tray cover to move from the closed position to the open position.

7. The feed tray assembly of claim 6, wherein the pawls are spring loaded to the extended position, and wherein depressing the release button rotates the pawls to the recessed position against the spring loading.

8. A belt-fed weapon having a feed tray assembly mounted at a top thereof, the feed tray assembly having a bottom tray portion and a feed tray cover, the bottom tray portion accepting a belt of ammunition for loading and firing a succession of round, the feed tray cover being mounted to the bottom tray portion and configured for lateral sliding opening and closing movement orthogonal to a firing direction of the belt-fed weapon, the feed tray cover having (1) a closed position in which the feed tray cover covers the bottom tray portion to retain the belt of ammunition during operation, and (2) an open position laterally displaced from the closed position to enable insertion of the belt of ammunition, wherein the feed tray cover has a pair of laterally extending pins that ride within corresponding elongated channels of the bottom tray portion to provide for the sliding opening and closing movement of the feed tray cover.

9. The belt-fed weapon of claim 8, further including a sighting optic mounted at the top adjacent to the feed tray assembly, the sighting optic having a forward portion extending above the feed tray assembly such that the lateral sliding opening and closing movement of the feed tray cover to avoid mechanical interference between the feed tray cover and the forward portion of the sighting optic.

10. The belt-fed weapon of claim 8, wherein the feed tray assembly has one or more retention knuckles co-configured with corresponding retention knuckles of an adjacent part of the weapon to receive a takedown pin to retain the feed tray assembly mounted at the top of the weapon.

11. The belt-fed weapon of claim 8, wherein the feed tray cover includes a release button enabling an operator to unlock the feed tray cover in the closed position and move the feed tray cover to the open position.

12. The belt-fed weapon of claim 11, wherein the feed tray cover includes a cross pin having end portions residing in corresponding cam paths of respective side walls of the bottom tray portion, and wherein the release button travels vertically to push the cross pin from a locked position to an unlocked position, enabling the lateral sliding movement of the feed tray cover.

13. The belt-fed weapon of claim 12, wherein the cross pin is spring-loaded and the release button applies force against the spring loading.

14. The belt-fed weapon of claim 11, wherein the feed tray cover includes a shroud portion surrounding the release button to protect against inadvertent activation of the release button by off-axis forces.

15. The belt-fed weapon of claim 11, wherein the feed tray cover includes one or more pawls that rotate between extended and recessed positions based on closed and open positions of the release button respectively, the pawls in the extended position contacting ammunition rounds and retaining them in position in the feed tray assembly, the pawls in the recessed position being clear of ammunition rounds in the feed tray assembly and permitting the feed tray cover to move from the closed position to the open position.

16. The belt-fed weapon of claim 15, wherein the pawls are spring loaded to the extended position, and wherein depressing the release button rotates the pawls to the recessed position against the spring loading.

* * * * *